US011484777B1

(12) United States Patent
Bouknight

(10) Patent No.: US 11,484,777 B1
(45) Date of Patent: Nov. 1, 2022

(54) WEDGE FOR BILLIARDS GULLY TRACK

(71) Applicant: Leonard Bouknight, West Columbia, SC (US)

(72) Inventor: Leonard Bouknight, West Columbia, SC (US)

( * ) Notice: Subject to any disclaimer, the term of this patent is extended or adjusted under 35 U.S.C. 154(b) by 232 days.

(21) Appl. No.: 16/902,332

(22) Filed: Jun. 16, 2020

(51) Int. Cl.
*A63D 15/20* (2006.01)
*A63D 15/00* (2006.01)
*A63D 15/06* (2006.01)

(52) U.S. Cl.
CPC ..... *A63D 15/003* (2013.01); *A63D 15/06* (2013.01); *A63D 2015/001* (2013.01)

(58) Field of Classification Search
CPC . A63D 15/003; A63D 15/06; A63D 2015/001
USPC ..... 473/1, 22
See application file for complete search history.

(56) References Cited

U.S. PATENT DOCUMENTS 556,532 A * 3/1896 Cunningham ..... A63D 15/00 473/22
680,759 A * 8/1901 Briggs ..... A63D 15/00 473/24
1,054,780 A * 3/1913 Lobstein, Jr. ..... A63D 15/00 473/22
1,222,284 A * 4/1917 Grode ..... A63D 15/00 473/22
1,237,419 A * 8/1917 Treiber ..... A63D 15/00 473/22
2,000,123 A * 5/1935 Cahill ..... A63F 7/0005 473/5
2,062,166 A * 11/1936 Delwiche ..... A63D 15/00 473/24
2,338,253 A * 1/1944 McCool ..... A63D 15/00 473/22
2,526,334 A * 10/1950 Cusano ..... A63F 7/0017 473/32
2,535,595 A * 12/1950 Park ..... A63D 15/00 473/22
2,923,546 A * 2/1960 Santiago ..... A63D 15/06 473/18
3,141,673 A * 7/1964 Scott ..... A63D 15/003 473/32
3,337,216 A * 8/1967 Miller ..... A63D 15/00 473/22
3,348,841 A * 10/1967 Heiss ..... A63D 15/00 473/20
3,466,037 A * 9/1969 Miller ..... A63D 15/00 473/24
3,522,778 A * 8/1970 Porath ..... A47B 3/00 473/20
3,653,665 A * 4/1972 Wahlberg ..... A63F 7/0023 473/18

(Continued)

FOREIGN PATENT DOCUMENTS

WO 0008973 2/2000

*Primary Examiner* — Mitra Aryanpour
(74) *Attorney, Agent, or Firm* — Kyle A. Fletcher, Esq.

(57) ABSTRACT

The wedge for billiard gutter track is a mechanical structure. The wedge for billiard gutter track is configured for use with a billiard table. The billiard table further includes a plurality of pocket structures and a ball return. The wedge for billiard gutter track braces the ball return against damage from the variable loads generated by any ball selected from the plurality of balls as the selected ball rolls into the ball return.

19 Claims, 4 Drawing Sheets

(56) References Cited

U.S. PATENT DOCUMENTS

| | | | | | |
|---|---|---|---|---|---|
| 3,967,821 | A * | 7/1976 | Bagley | A63D 15/00 | 473/24 |
| 3,989,244 | A * | 11/1976 | Wadina | A63D 15/006 | 473/2 |
| 4,114,876 | A * | 9/1978 | Maruszak | A63F 7/0628 | 473/20 |
| 4,155,549 | A * | 5/1979 | Mims | A63D 15/00 | 473/24 |
| 5,199,704 | A * | 4/1993 | Badami | A63D 15/006 | 473/2 |
| 5,249,767 | A | 10/1993 | Mellen | | |
| 5,290,012 | A | 3/1994 | Cottriel | | |
| 7,229,360 | B2 * | 6/2007 | Chevillotte | A63D 15/04 | 473/8 |
| 8,082,714 | B2 | 12/2011 | Burns | | |
| 9,717,336 | B1 | 8/2017 | Apple | | |
| D813,394 | S | 3/2018 | Dacosta | | |
| D856,128 | S | 8/2019 | Kazutaka | | |
| 2005/0087349 | A1 | 4/2005 | Corbett | | |

* cited by examiner

WEDGE FOR BILLIARDS GULLY TRACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical engineering and engineering elements including frames not specific to an apparatus, more specifically, a supporting base for a frame. (F16M7/00)

SUMMARY OF INVENTION

The wedge for billiard gutter track is a mechanical structure. The wedge for billiard gutter track is configured for use with a billiard table. The billiard table is defined elsewhere in this disclosure. The billiard table further comprises a plurality of pocket structures and a ball return. The plurality of pocket structures and the ball return are defined elsewhere in this disclosure. The billiard table is configured for use in a game selected from the group consisting of billiard and pool. The selected game further comprises a plurality of balls. The wedge for billiard gutter track braces the ball return against damage from the variable loads generated by any ball selected from the plurality of balls as the selected ball rolls into the ball return.

These together with additional objects, features and advantages of the wedge for billiard gutter track will be readily apparent to those of ordinary skill in the art upon reading the following detailed description of the presently preferred, but nonetheless illustrative, embodiments when taken in conjunction with the accompanying drawings.

In this respect, before explaining the current embodiments of the wedge for billiard gutter track in detail, it is to be understood that the wedge for billiard gutter track is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wedge for billiard gutter track.

It is therefore important that the claims be regarded as including such equivalent construction insofar as they do not depart from the spirit and scope of the wedge for billiard gutter track. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
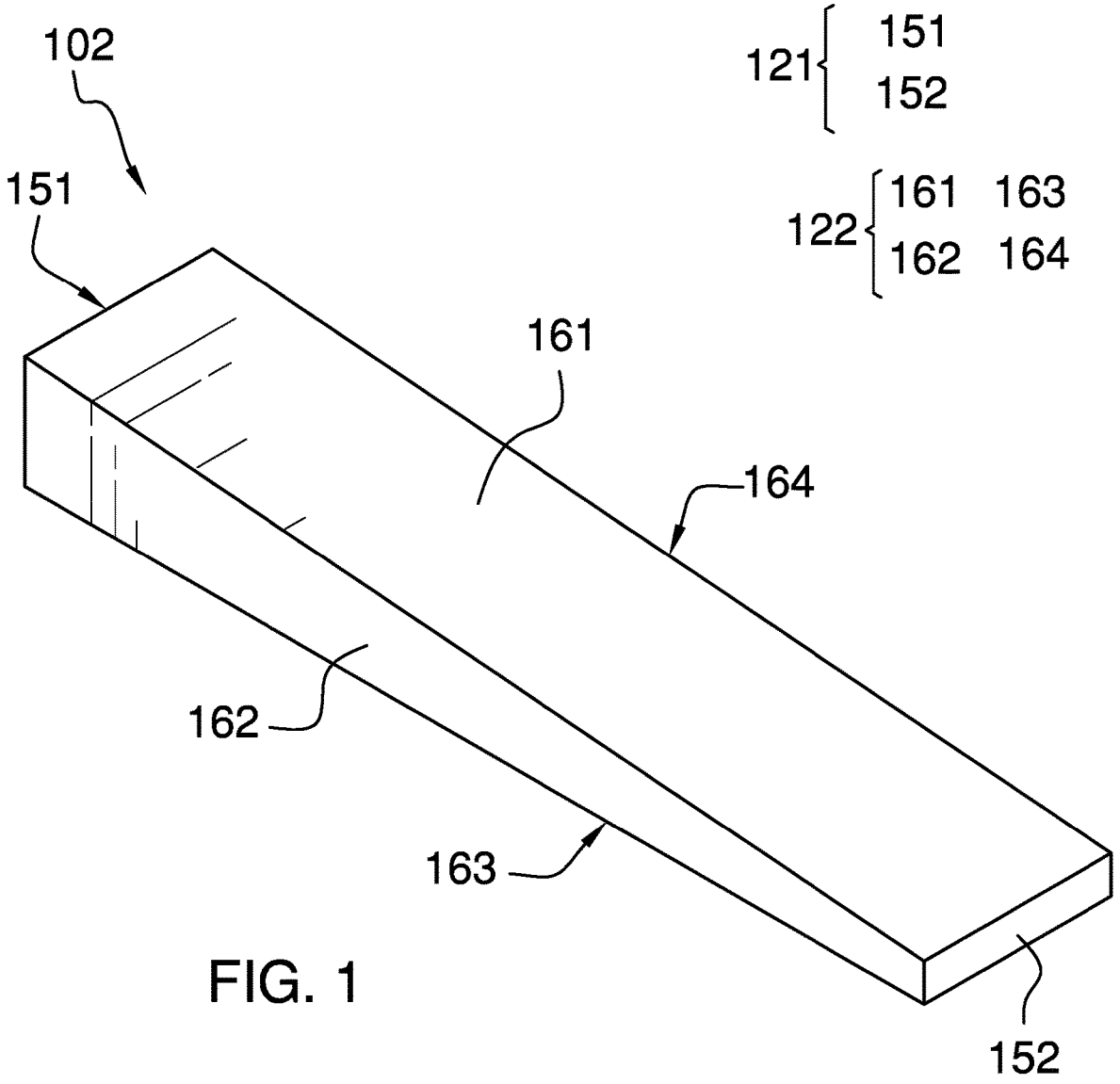
FIG. 1 is a perspective view of an embodiment of the disclosure.
Figure 2:
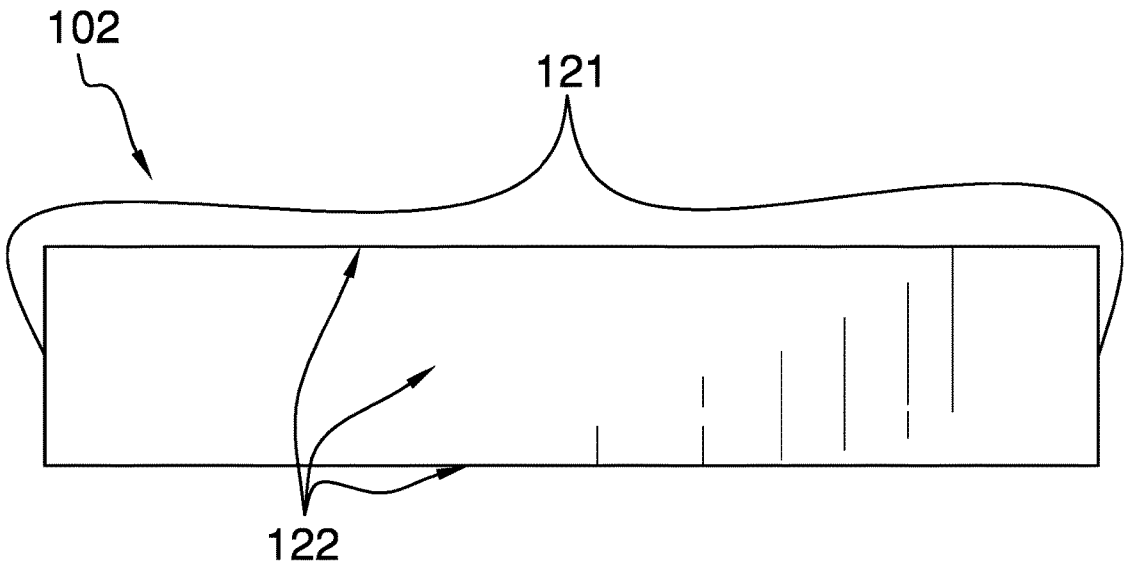
FIG. 2 is a bottom view of an embodiment of the disclosure.
Figure 3:
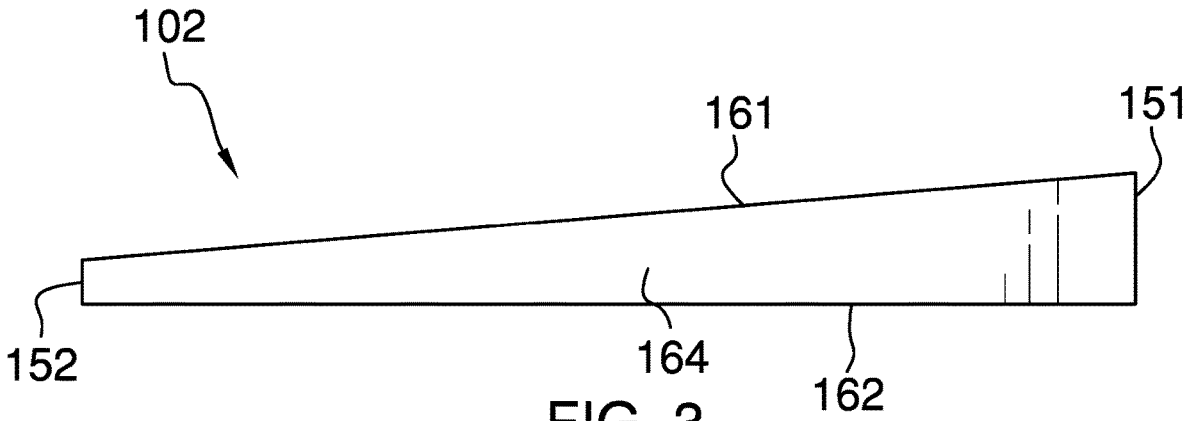
FIG. 3 is a side view of an embodiment of the disclosure.
Figure 4:
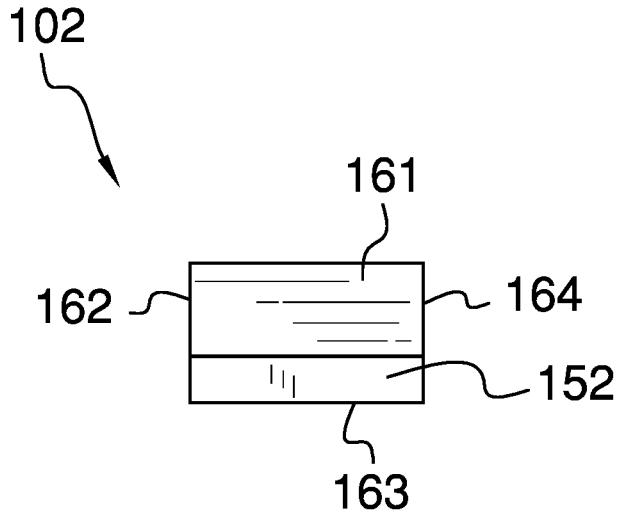
FIG. 4 is a front view of an embodiment of the disclosure.
Figure 5:
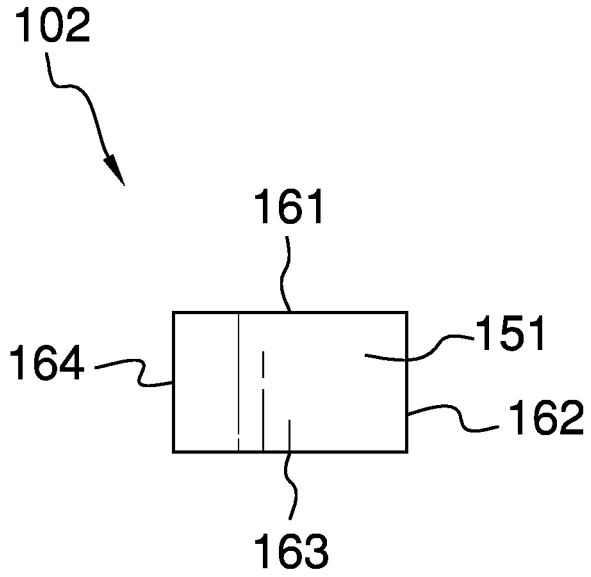
FIG. 5 is a rear view of an embodiment of the disclosure.
Figure 6:
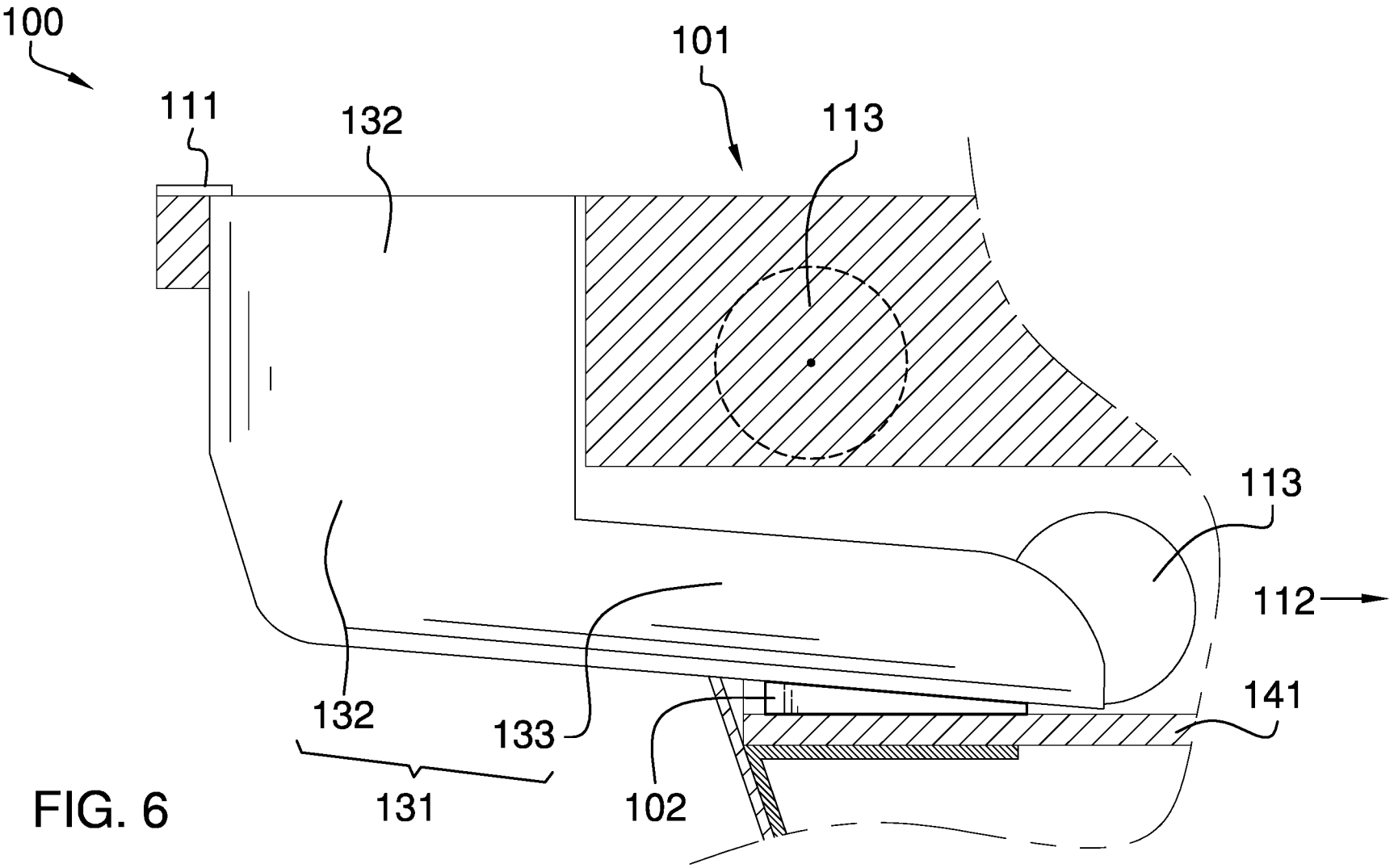
FIG. 6 is an in-use view of an embodiment of the disclosure.

Detailed reference will now be made to one or more potential embodiments of the disclosure, which are illustrated in FIGS. 1 through 6.

The wedge for billiard gutter track 100 (hereinafter invention) is a mechanical structure. The invention 100 is configured for use with a billiard table 101. The billiard table 101 is defined elsewhere in this disclosure. The billiard table 101 further comprises a plurality of pocket structures 111 and a ball return 112. The plurality of pocket structures 111 and the ball return 112 are defined elsewhere in this disclosure. The billiard table 101 is configured for use in a game selected from the group consisting of billiard and pool. The selected game further comprises a plurality of balls 113. The invention 100 braces the ball return 112 against damage from the variable loads generated by any ball selected from the plurality of balls 113 as the selected ball rolls into the ball return 112. The invention 100 comprises the billiard table and a wedge 102. The wedge 102 installs in the billiard table 101.

The billiard table 101 is a furniture item that is configured for use with a selected game of skill. The billiard table 101 is defined elsewhere in this disclosure. The billiard table 101 comprises a plurality of pocket structures 111, a ball return 112, and a plurality of balls 113.

Each of the plurality of pocket structures 111 forms a drain structure. Each of the plurality of pocket structures 111 receives a ball selected from the plurality of balls 113 that is removed from the billiard table 101 during the course of the play of the selected game of skill. Each of the plurality of pocket structures 111 transports the received ball into the ball return 112. The plurality of pocket structures 111 comprises a collection of individual pocket structures 131.

The individual pocket structure 131 is a mechanical structure that is installed in the billiard table 101. The individual pocket structure 131 is sized to receive a ball selected from the plurality of balls 113 during the course of play of the selected game of skill. The individual pocket structure 131 forms a drain that receives the selected ball and transports the selected ball to the ball return 112. Each individual pocket structure 131 comprises a receiving pocket 132 and a pocket gutter 133.

The receiving pocket 132 is the collection structure of the individual pocket structure 131. The receiving pocket 132 forms an aperture in the pan structure of the billiard table 101 that receives a ball selected from the plurality of balls 113 during the course of the play of the selected game of skill. The receiving pocket 132 transports the received ball to the pocket gutter 133.

The pocket gutter 133 is a mechanical structure. The pocket gutter 133 forms a transport path that transports each ball selected from the plurality of balls 113 received by the receiving pocket 132 to the ball return 112. The pocket gutter 133 is a trough-shaped structure. The pocket gutter 133 is formed with a cant relative to the force of gravity. The cant of the pocket gutter 133 creates a gravity feed system that transports each received ball to the ball return 112.

The ball return 112 is a mechanical structure. The ball return 112 receives each ball selected from the plurality of balls 113 that is deposited into a pocket structure selected from the plurality of pocket structures 111 during the course of the play of the selected game of skill. The ball return 112 transports each received ball to a collection point. The ball return 112 further comprises a return surface 141.

The return surface 141 is a planar surface that forms the supporting surface for each ball selected from the plurality of balls 113 that is received into the ball return 112. The return surface 141 is formed with a cant relative to the force of gravity such that the ball return 112 forms a gravity powered system that transports each received ball to the collection point.

Each of the plurality of balls 113 is a spherical structure that is used in the play of the selected game of the skill. The ball return 112, the ball, and the pocket structure are defined elsewhere in this disclosure.

The wedge 102 is a prism structure. The wedge 102 has a tapered prism shape. The prism and the tapered prism are defined elsewhere in this disclosure. The wedge 102 is a bracing structure. The wedge 102 is forced into a space between the pocket gutter 133 of an individual pocket structure 131 selected from the plurality of pocket structures 111 and the superior surface of the return surface 141 of the ball return 112. The wedge 102 fixes the pocket gutter 133 into a rigid position such that a ball selected from the plurality of balls 113 that rolls through the pocket gutter 133 will not shift the pocket gutter 133 relative to the ball return 112. The wedge 102 comprises a plurality of congruent ends 121 and a plurality of lateral faces 122.

Each congruent end of the plurality of congruent ends 121 forms a congruent end of the tapered prism structure of the wedge 102. Each congruent end of the plurality of congruent ends 121 is perpendicular to the center axis of the tapered prism structure of the wedge 102. Each congruent end of the plurality of congruent ends 121 is perpendicular to the major axis of the tapered prism structure of the wedge 102. Each congruent end of the plurality of congruent ends 121 has a rectangular shape. The plurality of congruent ends 121 further comprises a first congruent end 151 and a second congruent end 152.

The first congruent end 151 is the congruent end of the tapered prism structure of the wedge 102 with the greatest surface area. The second congruent end 152 is the congruent end of the tapered prism structure of the wedge 102 with the least surface area. The second congruent end 152 is the congruent end of the tapered prism structure of the wedge 102 that is distal from the first congruent end 151. The second congruent end 152 is the congruent end of the tapered prism structure of the wedge 102 that forms the leading edge as the wedge 102 is forced between the return surface 141 and the pocket gutter 133.

The plurality of lateral faces 122 forms the lateral face structure of the tapered prism structure of the wedge 102. Each lateral face selected from the plurality of lateral faces 122 has a rectangular shape. The plurality of lateral faces 122 further comprises a first lateral face 161, a second lateral face 162, a third lateral face 163, and a fourth lateral face 164.

The first lateral face 161 is the lateral face selected from the plurality of lateral faces 122 with the greatest surface area. The second lateral face 162 is the lateral face selected from the plurality of lateral faces 122 with the least surface area. The third lateral face 163 is the lateral face selected from the plurality of lateral faces 122 that is distal from the first lateral face 161. The fourth lateral face 164 is the lateral face selected from the plurality of lateral faces 122 that is distal from the second lateral face 162. The third lateral face 163 is the lateral face of the wedge 102 that rests upon the return surface 141 of the ball return 112. The first lateral face 161 is the lateral face of the wedge 102 that presses against the pocket gutter 133 of the individual pocket structure 131.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Ball: As used in this disclosure, a ball refers to an object with a spherical or nearly spherical shape.

Billiard Table: As used in this disclosure, a billiard table, also known as a pool table, is an elevated, pan shaped structure with surfaces. The pan shaped structure forms a negative space with a rectangular disk structure. The closed face of the pan structure forms a horizontally oriented surface. The containment space formed by the pan structure is covered in a fabric. The billiard table is used in the play of several games of skill that generally comprise a plurality of balls and a cue stick. The plurality of balls are placed in the pan structure of the billiard table. In a typical billiard game, a first ball selected from the plurality of balls is struck by the cue stick such that the first ball strikes a second ball. The first ball may or may not be bounced off the vertical faces of the pan structure of the billiard table. The goal of the several games of skill will vary. In support of a subset of the games of skill, the billiard table can be further fitted with a plurality of pockets. The plurality of pockets comprises six pockets. Each of the six pockets are positioned at a location selected from the group consisting of: a) a vertex of the pan structure; and, b) the midpoint of a lateral face of the pan shape that is parallel to the major axis of the pan shaped structure. Each of the plurality of pockets is often fitted with a pocket gutter and a ball return. The ball return forms a path the channels balls that enter a pocket selected from the plurality of pockets to collection station where the returned balls await further use. The pocket gutter is a trough associated with each of the plurality of pockets that guides each received ball to the ball return.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a negative space that forms a prism-shaped passage through which an object or fluid passes through. Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drain: As used in this disclosure, a drain is a mechanical substructure of a larger mechanical structure that uses gravity to remove an object from the larger mechanical structure.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Game: As used in this disclosure, a game is a competition between two or more players wherein each of the two or more players attempt to outperform the other players according to a previously determined set of rules. The winner of the game is traditionally rewarded with social or economic benefits. The primary purpose of a game is often to provide entertainment.

Game of Skill: As used in this disclosure, a game of skill is a competition wherein the outcome of the competition will at least partially depends upon the skill of a player.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Orientation: As used in this disclosure, orientation refers to the positioning of a first object relative to: 1) a second object; or, 2) a fixed position, location, or direction.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Sphere: As used in this disclosure, a sphere refers to a structure wherein every point of the surface of the structure is equidistant from a center point.

Superior: As used in this disclosure, the term superior refers to a directional reference that is parallel to and in the opposite direction of the force of gravity when an object is positioned or used normally.

Tapered Prism Structure: As used in this disclosure, a tapered prism structure is a modified prism structure that is formed such that the first congruent end of the modified prism structure is geometrically similar to, but not geometrically identical to the second congruent end of the modified prism. The span of the length of a radial line from the center axis to the lateral face of the modified prism structure will vary as a function of its position along the center axis. Always use taper.

Trough: As used in this disclosure, a trough refers to a three sided structure with a cross-section that has U-shaped appearance. A gutter is an example of a trough.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An apparatus comprising
a billiard table and a wedge;
wherein the wedge installs in the billiard table;
wherein the apparatus is a mechanical structure;
wherein the billiard table further comprises a plurality of pocket structures and a ball return;
wherein the wedge is a bracing structure that prevents damage to the ball return of the billiard table;
wherein the wedge fixes the pocket gutter into a rigid position such that a ball selected from the plurality of balls that rolls through the pocket gutter will not shift the pocket gutter relative to the ball return.

2. The apparatus according to claim 1
wherein the billiard table is a furniture item that is configured for use with a selected game of skill;
wherein the billiard table is configured for use in a game selected from the group consisting of billiard and pool;
wherein the selected game further comprises a plurality of balls.

3. The apparatus according to claim 2
wherein each of the plurality of pocket structures forms a drain structure;
wherein each of the plurality of pocket structures receives a ball selected from the plurality of balls that is removed from the billiard table during the course of the play of the selected game of skill.

4. The apparatus according to claim 3
wherein each of the plurality of pocket structures transports the received ball into the ball return;
wherein the plurality of pocket structures comprises a collection of individual pocket structures;
wherein the individual pocket structure is sized to receive a ball selected from the plurality of balls during the course of play of the selected game of skill.

5. The apparatus according to claim 4
wherein the individual pocket structure is a mechanical structure that is installed in the billiard table;
wherein the individual pocket structure forms a drain that receives the selected ball and transports the selected ball to the ball return.

6. The apparatus according to claim 5
wherein each individual pocket structure comprises a receiving pocket and a pocket gutter;
wherein the receiving pocket transports the received ball to the pocket gutter.

7. The apparatus according to claim 6
wherein the receiving pocket is the collection structure of the individual pocket structure;
wherein the receiving pocket forms an aperture in a pan structure of the billiard table that receives a ball selected from the plurality of balls during the course of the play of the selected game of skill.

8. The apparatus according to claim 7
wherein the pocket gutter is a mechanical structure;
wherein the pocket gutter forms a transport path that transports each ball selected from the plurality of balls received by the receiving pocket to the ball return.

9. The apparatus according to claim 8
wherein the pocket gutter is a trough-shaped structure;
wherein the pocket gutter is formed with a cant relative to the force of gravity;
wherein the cant of the pocket gutter creates a gravity feed system that transports each received ball to the ball return.

10. The apparatus according to claim 9
wherein the ball return is a mechanical structure;
wherein the ball return receives each ball selected from the plurality of balls that is deposited into a pocket structure selected from the plurality of pocket structures during the course of the play of the selected game of skill.

11. The apparatus according to claim 10
wherein the ball return further comprises a return surface;
wherein the return surface is a planar surface that forms the supporting surface for each ball selected from the plurality of balls that is received into the ball return;
wherein the return surface is formed with a cant relative to the force of gravity such that the ball return forms a gravity-powered system that transports each received ball to the collection point;
wherein each of the plurality of balls is a spherical structure that is used in the play of the selected game of the skill.

12. The apparatus according to claim 11
wherein the wedge is a prism structure;
wherein the wedge has a tapered prism shape.

13. The apparatus according to claim 12 wherein the wedge is forced into a space between the pocket gutter of an individual pocket structure selected from the plurality of pocket structures and the superior surface of the return surface of the ball return.

14. The apparatus according to claim 13
wherein the wedge comprises a plurality of congruent ends and a plurality of lateral faces;
wherein each congruent end of the plurality of congruent ends forms a congruent end of the tapered prism structure of the wedge;
wherein the plurality of lateral faces forms the lateral face structure of the tapered prism structure of the wedge.

15. The apparatus according to claim 14
wherein each congruent end of the plurality of congruent ends is perpendicular to the center axis of the tapered prism structure of the wedge;
wherein each congruent end of the plurality of congruent ends is perpendicular to the major axis of the tapered prism structure of the wedge.

16. The apparatus according to claim 15
wherein each congruent end of the plurality of congruent ends has a rectangular shape;
wherein each lateral face selected from the plurality of lateral faces has a rectangular shape.

17. The apparatus according to claim 16
wherein the plurality of congruent ends further comprises a first congruent end and a second congruent end;
wherein the first congruent end is the congruent end of the tapered prism structure of the wedge with the greatest surface area;
wherein the second congruent end is the congruent end of the tapered prism structure of the wedge with the least surface area;
wherein the second congruent end is the congruent end of the tapered prism structure of the wedge that is distal from the first congruent end.

18. The apparatus according to claim 17
wherein the plurality of lateral faces further comprises a first lateral face, a second lateral face, a third lateral face, and a fourth lateral face;
wherein the first lateral face is the lateral face selected from the plurality of lateral faces with the greatest surface area;
wherein the second lateral face is the lateral face selected from the plurality of lateral faces with the least surface area;
wherein the third lateral face is the lateral face selected from the plurality of lateral faces that is distal from the first lateral face;
wherein the fourth lateral face is the lateral face selected from the plurality of lateral faces that is distal from the second lateral face.

19. The apparatus according to claim 18
wherein the second congruent end is the congruent end of the tapered prism structure of the wedge that forms the leading edge as the wedge is forced between the return surface and the pocket gutter;
wherein the third lateral face is the lateral face of the wedge that rests upon the return surface of the ball return;
wherein the first lateral face is the lateral face of the wedge that presses against the pocket gutter of the individual pocket structure.

* * * * *